United States Patent [19]

Zimmerman

[11] 4,239,069

[45] Dec. 16, 1980

[54] AUTOMATIC CANT PRODUCTION MACHINE

[76] Inventor: Edwin H. Zimmerman, R.D. 1, New Holland, Pa. 17557

[21] Appl. No.: 65,509

[22] Filed: Aug. 10, 1979

[51] Int. Cl.[3] ..... B27C 9/04

[52] U.S. Cl. ..... 144/39; 144/136 H; 144/312; 144/326 R

[58] Field of Search ..... 144/37, 39, 41, 136 R, 144/312, 326 R

[56] References Cited

U.S. PATENT DOCUMENTS

| | | | |
|---|---|---|---|
| 555,037 | 2/1896 | Dees | 83/724 |
| 1,825,041 | 3/1929 | Babare | 144/39 |
| 2,684,088 | 7/1954 | Miller | 144/41 |
| 3,259,157 | 7/1966 | Runnion | 144/312 |
| 3,304,971 | 2/1967 | Pease | 144/312 |
| 3,313,329 | 4/1967 | Mitten | 144/312 |
| 3,454,063 | 7/1969 | Mitten | 144/326 R |
| 3,457,978 | 7/1969 | Ahlsted | 144/312 |
| 3,552,457 | 1/1971 | Bos | 144/312 |
| 3,738,404 | 6/1973 | Walker | 144/312 |
| 4,117,755 | 10/1978 | Hasenwinkle | 144/312 |

*Primary Examiner*—R. L. Spruill
*Attorney, Agent, or Firm*—C. Hercus Just

[57] ABSTRACT

A woodworking machine to convert round logs to square or rectangular cants by initially cutting with initial chipping cutters pairs of adjacent grooves respectively in the opposite upper and lower surfaces of each log to form corners of said cant thereon and also form the side edges of four boards to be sawed from the log incident to forming the cant, and then delivering the log to a conveyor extending between the inlet and discharge ends of the machine and having support elements thereon complementary to the lower cant corner of said logs and additional series of guide elements above and coextensive with said conveyor which engage the upper corner of said cant on the log, whereby the log is securely and accurately held between said conveyor and guide elements during a single passage through the machine during which, downstream from the inlet end of the machine, additional chipping cutters form other pairs of grooves respectively in the opposite sides of said logs to define side corners of the cant and also remove slag sections from four areas of the log respectively between the said pairs of grooves on said log and, farther downstream along the conveyor, pairs of rotary saws respectively at a right angle to each other are positioned to saw from the log between the successive sides of the pairs of grooves two boards from opposite sides of the upper portion of the log and two boards from the lower portion of the log while guided and held between said conveyor and additional guide elements, the cuts made by said saws also forming the ultimate side surfaces of the cant.

25 Claims, 20 Drawing Figures

STATION 1

STATION 2

STATION 3

STATION 4

Fig. A
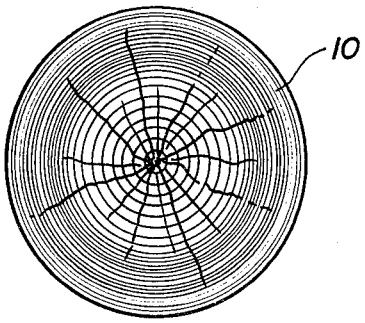
Fig. D
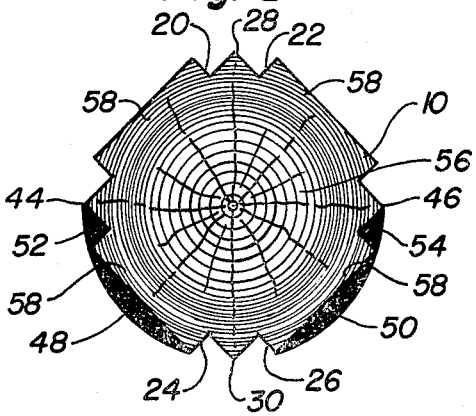
Fig. B
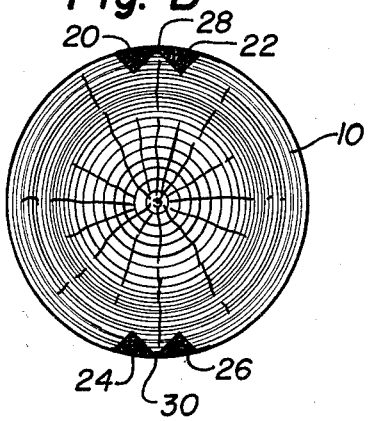
Fig. E
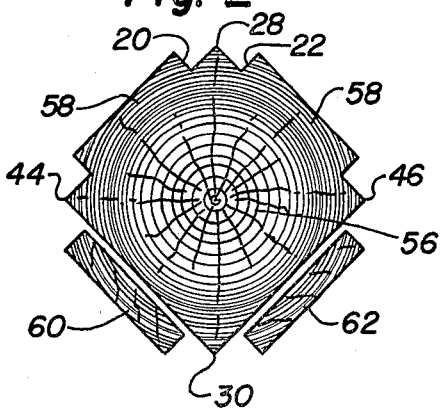
Fig. C
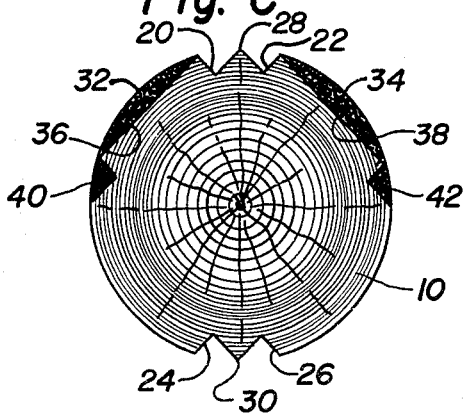
Fig. F
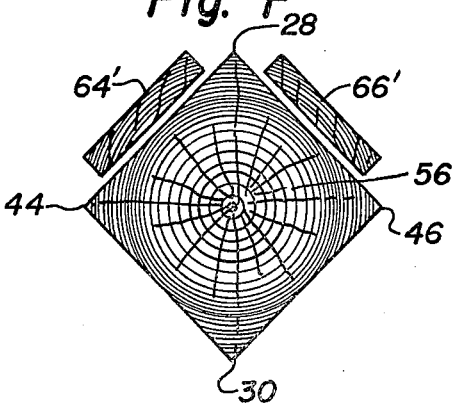

AUTOMATIC CANT PRODUCTION MACHINE

BACKGROUND OF THE INVENTION

For purposes of effecting economy in the lumber industry and also to maximize the production of useable lumber pieces from logs, both large and small, numerous attempts have been made in the development of machinery to saw and otherwise convert round logs into such useful articles of lumber. Typical of some of these prior references are the following U.S. Pat. Nos.:

555,037, Dees, Feb. 18, 1896
3,259,157, Runnion, July 5, 1966
3,304,971, Pease, Feb. 21, 1967
3,313,329, Mitten, April 11, 1967
3,552,457, Bos, Jan. 5, 1971

The Dees patent shows several systems for sawing logs into boards in order to maximize the number and shapes of boards produced by a single log. Runnion is concerned primarily with producing dimensional or useful lumber from small-diameter logs and incident to doing so, ribs are formed with parallel sides on the bottoms of the logs and these are used to guide the logs through the mill apparatus. Pease also forms useful lumber pieces from small-diameter logs and employs both chipping and sawing to accomplish the same. The Mitten patent is a more recent development than the prior patents referred to above and pertains to a machine for cutting by chipping two diametrically opposite flat surfaces respectively from the top and bottom of logs and also forms a segment and two notches, said flat surfaces and inner walls of the notches being employed as bearing surfaces to guide the log during the following stages of treatment.

The Bos patent pertains to forming a square cant as well as chipping outer portions of a log to form the outer surfaces of boards respectively sawed from the ultimate faces of the square cant. During the processing of the log, a central chipper head forms a V-shaped notch in the top of the log, followed by additional chipper heads respectively chipping flat surfaces at a right angle to each other respectively at opposite sides of said central chipper head while the original curved surface on the bottom of the log is supported by appropriate rollers. After shaping the log to form two boards on the opposite sides of the central upper V-shaped notch and sawing the boards therefrom, it is necessary to rotate the log 180° in order to similarly process the initial lower half of the log into two additional boards and also form the remaining two surfaces of the square cant. Sawing of the boards from the cant is accomplished by band saws spaced longitudinally along the path of travel of the log and then after the log is turned following the completion of the formation of the two upper surfaces of the cant and removal of the two top boards, another pass, separate from the first pass, must be made in order to process the bottom half of the log to equal the product produced by the first pass through the machine, such additional passage through the machine being time-consuming, as well as requiring means to rotate the log 180° between passes.

SUMMARY OF THE INVENTION

It is among the principal objects of the invention to expedite the transformation of round logs into a cant which is either square or rectangular in cross-section and incidentally form four boards accurately and efficiently by a single passage of a log through the entire machine comprising the present invention. To accomplish this, pairs of adjacent V-shaped notches are initially formed respectively in the uppermost and lowermost surfaces of a round log as it is introduced to the inlet of the machine, the adjacent walls of said notches being at 90° to each other and comprising respectively an upper and lower corner of the cant which ultimately is produced as a result of a single passage of the log through the machine. A conveyor having an upper coarse, extending between the inlet and discharge ends of the basic frame of the machine, is provided with guide and support elements having notches in the upper surfaces thereof complementary to the lower cant corner referred to above, while additional support elements preferably in the form of grooved rollers, are disposed in a line above and parallel to said upper coarse of the conveyor for purposes of simultaneously engaging the upper cant corner in the log and this support and guiding of the log through the machine from one end to the other continues while all other operations are performed upon the log as described below. In regard to this objective of the invention, it is presumed that the logs to be processed by the machine have been debarked and, in general, are of substantially the same general diameter throughout the length of the log, within reasonable limits.

Another object of the invention is to provide, downstream along the conveyor from the inlet end where the formation of the upper and lower can corners occurs along the log, pairs of associated elongated chipping rollers respectively rotatable about axes at a right angle to each other and respectively at 45° on opposite sides of an imaginary vertical plane bisecting the path of movement of the logs through the machine, one pair of associated chipping rollers or cutters respectively engaging opposite sides of the upper portion of the log, while a second pair of such chipping rollers respectively engage opposite sides of the lower portion of the log to form flat surfaces on the log parallel to the axes of said rotatable chipping rollers and respectively at right angles to each other and also respectively on the upper and lower portions of said log to form the outer surfaces of boards subsequently to be sawed from the cant portion of the log while passing through the machine, whereby useful portions of the log to form boards are preserved, while the silvers and chips removed by the chipping rollers are of a type suitable for use in pulping procedures to form paper.

A further object of the invention is to use step-typed chipping rollers which are elongated and the major portions of which are substantially cylindrical, while at one end, the diameter of the chipper roller is increased for purposes of forming relative to the upper half of the log, single notch in the opposite sides thereof and the chipping rollers which engage the opposite sides of the lower portion of the log, have the enlarged chipping ends thereof positioned to engage the opposite sides of the log and form additional single notches immediately adjacent the single notches formed by the enlarged ends of the chipping rollers which engage the opposite sides of the upper portion of the log, thereby forming side corners of the cant ultimately being formed by a single passage through the machine.

Still another object of the invention is to provide two pairs of circular saws, the saws of each pair respectively being disposed at a right angle to each other and parallel to the planes within which the axes of the rotatably chipping rollers are disposed, one of said pairs of saws engaging the upper portion of the log downstream from the location of the chipping rollers and the other pair of saws engaging the lower portions of the log and disposed within planes parallel to the axes of the chipping rollers which engage the lower portion of the log, said pairs of saws being spaced axially along the path of movement of the log through the machine and all of said saws being disposed within planes common to the opposite faces of the corners of the cant formed by the chipping rollers and, therefore, being operable to saw from the log within said planes four boards of which the outer surfaces have been formed by the chipping rollers and the opposite edges of said boards having been formed respectively by the chipping rollers which initially form the uppermost and lowermost corners of the cant, as well as the enlarged ends of the chipping rollers which form the pairs of grooves in the opposite sides of the log, the removal of the boards from the log producing the desired square or rectangular cant which through its entire single passage through the machine has been supported and guided by said uppermost and lowermost cant corners being held between the corveyor and additional guide means above the same.

Still another object of the invention is to provide an elongated base frame for the machine which supports by suitable means the aforementioned conveyor, the initial chipping rollers at the inlet end of the machine which form the lowermost cant corner in the log, the lower pair of chipping rollers which are disposed at a right angle to each other and engage the lower half of the log, as well as the pair of saws positioned at a right angle with respect to each other and arranged to saw the two boards from the lower half of the log, and also provide an upper auxiliary frame which is substantially coextensive with the lower base frame and is supported by adjustable means to permit movement of the upper auxiliary frame toward and from the lower base frame for purposes of accommodating logs of different diameter, the upper auxiliary frame supporting in sequence from the inlet end of the machine, the initial chipping rollers which form the uppermost corner of the cant to be formed from the log, the upper pair of chipping rollers which engage opposite sides of the upper half of the log, and the pair of rotary saw blades which are disposed at right angles to each other and respectively saw from the upper half of the log, the pair of boards removed therefrom by said saws.

A still further object of the invention is to provide support means for the upper auxiliary frame in the form of screw jacks and include driving mechanism therefor by which the screws are all rotated simultaneously by power means and said screws being respectively located along opposite sides of the base and auxiliary frames, as well as being spaced longitudinally therealong and, thus, form firm support and adjustable capabilities for the upper auxiliary frame with respect to the lower base frame.

A still further object of the invention ancillary to the frame structure is to provide frame means capable of enabling the machine to produce cants of the order of approximately six inches or less square up to sixteen inches or more square, depending upon the size of the logs being processed and to accomplish this, while minimizing adjustment operations on the machine, the machine is provided with upper and lower elongated frame members which consist essentially of a single sturdy metal beam for each frame, in combination with transverse frame members at opposite ends, the lower frame, which is the base frame, also having sturdy vertical posts which comprise corners of the frame, and guide means on the ends of the end frame members of the upper frame engage said posts for guidance, while screw jacks extend vertically between the end frame members adjacent said posts for simultaneous operation to effect vertical adjustment between the upper and lower frame members to comprise the only major adjustment of the machine necessary to enable the machine to process logs and produce cants within the size ranges, for example, such as those set forth above.

The reason for the single elongated beam for each frame is to employ it to support transverse mounting members such as sturdy steel plates, at longitudinally spaced locations and extending equally in opposite directions from said beams, respectively to support chipping cutters and rotary saws and motors, the upper and lower frames each supporting certain ones respectively for operation on the upper and lower portions of a log as it makes a single passage through the machine to form a single cant, either with or without boards being formed, as desired.

Still another object of the machine is to enable the machine to process both softwood and hardwood logs and especially the latter, without changing chipping cutters or saw blades, and to accomplish this, in particular, the rotary saws and chipping cutters are provided with hard tips on the teeth, such as tungsten carbide, the chipping cutters also comprising a gang of selected shapes of rotary cutters mounted in clamped side-by-side abutting relation upon arbors, as distinguished from circular chipping cutters having cutting teeth on one circular face as now commonly employed in lumber processing machines presently used primarily to chip softwood timber, the chipping cutters and rotary saws of the invention also having peripheral teeth of a type capable of producing silvers and chips suitable for pulping, as distinguished from common type saw dust.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 4 is an exemplary additional guide means engageable with the uppermost corner of a cant as formed in the machine to cooperate with the conveyor for purposes of accurately and positively positioning a log throughout its entire passage through the machine, said guide means being secured to a portion of the upper frame of the machine which is shown only fragmentarily and the view of a larger scale than used in other figures in which said guide means is also illustrated.

Figure 1:
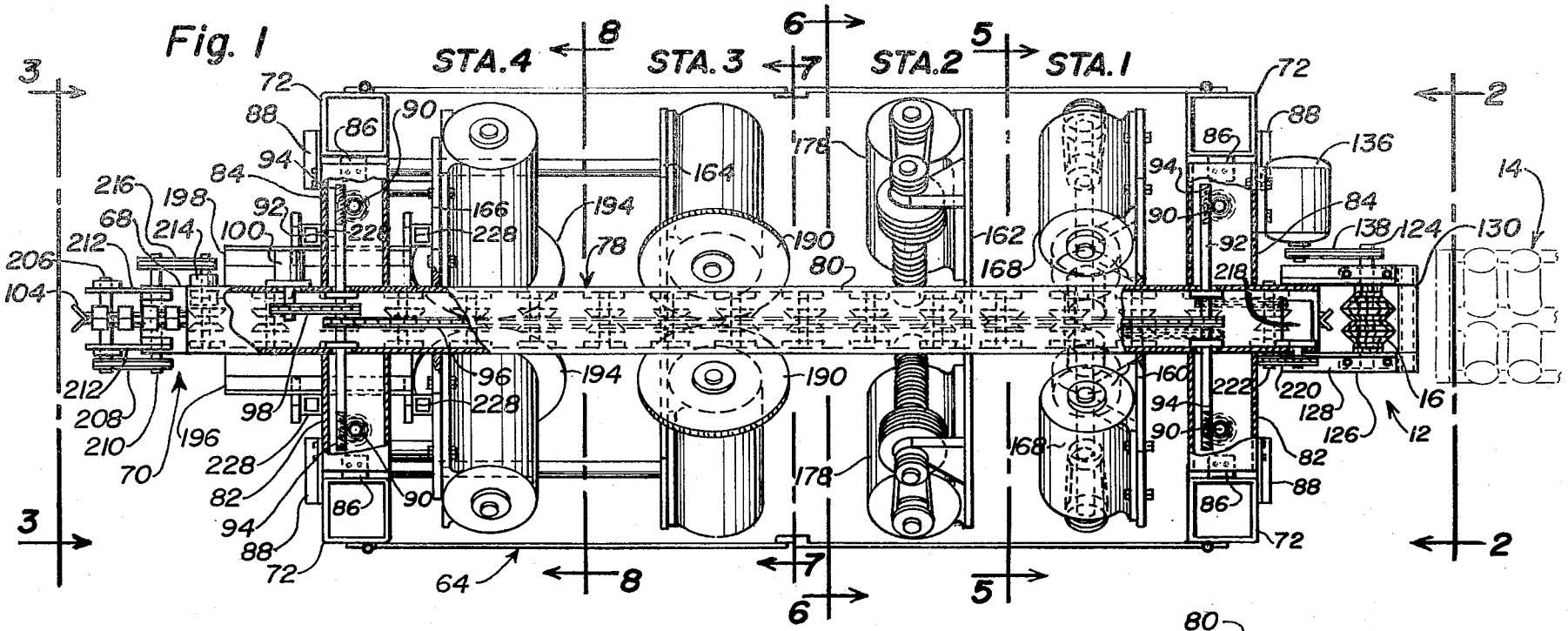
FIG. 1 is a top plan view of an exemplary machine embodying the principles of the present invention, portions of the opposite ends thereof being broken away fragmentarily to disclose portions of the details of said structure.

FIGS. A-F respectively illustrate in vertical sectional manner the various steps by which the machine comprising the invention operates upon a round log ultimately to form a cant having four sides disposed at right angles to each other and four boards removed from the slab portions of said log, the first step of the procedure being shown in FIG. B, in which pairs of grooves respectively are formed in the upper and lower surfaces of the log to form therebetween upper and lower corners of the cant ultimately formed from said log, FIG. C showing by stippling partial slab portions to be removed by chipping operations, together with a single groove respectively formed in opposite sides of the log, FIG. D showing by stippling additional partial slab portions to be removed from the lower portion of the log, together with forming an additional single groove respectively in opposite sides thereof to cooperate with the grooves shown in FIG. C to form side corners of a cant ultimately formed by the machine, whereby the log is in condition to have a pair of boards sawed respectively from opposite sides of the lower portion of the log as shown in FIG. E, together with forming two side surfaces of the cant and in FIG. F, a pair of boards are sawed from the upper portion of the log to complete the formation of the square cant comprising the major objective of the invention.

DETAILED DESCRIPTION OF THE PREFERRED EMBODIMENT

The principal purpose of the present invention is to provide a lumber-producing machine capable of expediting the formation of (1) a cant having four sides arranged at a right angle to each other and preferably square in cross-section, (2) at least four boards removed from what is known as the slab section or portion of a log, and (3) chips and silvers removed from partial slab section of the log, as well as incident to forming pairs of grooves respectively in the upper and lower, as well as side portion of the log, said chips and slivers being of a type suitable for pulping operations in paper manufacturing and all of said process being conducted by making a single pass of the log through the machine automatically while the log is accurately held by upper and lower support and positioning guide means respectively engaging elongated ridges in the upper and lower portions of a log which are initially formed by chipping means to form the ultimate upper and lower corners of the cant which are elongated ridges continuously engaged by a conveyor and upper guide means throughout the entire passage of the log through the machine from the inlet to the discharge ends thereof.

Figure 9:
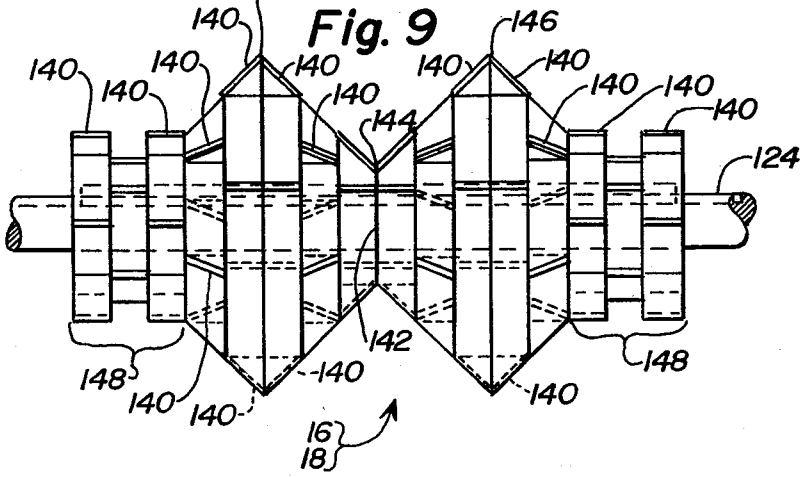
FIG. 9 is an enlarged front elevation showing an assembly of chipping cutters of the type supported upon the machine adjacent the inlet end thereof and respectively above and below the path of travel for a log when passing through said machine and adapted to respectively cut pairs of grooves in the upper and lower surfaces of the log to form elongated ridges comprising upper and lower corners of a cant to be formed by the machine, the assembly of cutters being illustrated on a fragmentary section of an arbor.

The successive operations performed upon a log are illustrated diagrammatically in cross-section in FIGS. A–F of the drawings and to perform said various steps and procedures, the machine is provided sequentially with a plurality of operation stations respectively including upper and lower chipping cutters at opposite sides of a vertical plane respectively adapted to engage the upper and lower portions of a log, followed by pairs of circular saws respectively engageable with opposite sides of upper and lower portions of said log to remove boards from the cant ultimately formed by the machine, said operational stations being positioned compactly within said machine to minimize the overall length thereof and details of said stations, as well as the overall construction of the machine are as follows:

As indicated above, the machine comprising the present invention is intended to operate upon substantially circular logs which have been debarked and one exemplary illustration of such log is shown in cross-section in FIG. A, comprising log 10. As the log is introduced to the inlet end 12 of the machine, by means of a suitable conveyor 14 fragmentarily illustrated in phantom in FIG. 1, it is first engaged by preliminary compound upper and lower chipping cutters 16 and 18, see FIG. 4, details of which are shown in FIG. 9 and described hereinafter, for purposes of forming pairs of adjacent notches 20 and 22 in the upper surface of the log 10, as shown in FIG. B, wherein the material removed from the log to form said notches is stippled and, simultaneously, a similar pair of adjacent notches 24 and 26 are formed in the lower surface of the log 10, as shown in FIG. B, for purposes of forming respectively the upper and lower corners 28 and 30, which are diametrically opposite each other and comprise elongated ridges which extend throughout the length of the log and the opposite sides thereof are precisely at 90° with respect to each other, thereby forming a desirable pair of opposite corners for the ultimate cant to be produced by the machine.

It will be understood as described hereinafter that the upper and lower cant corners 28 and 30 are engaged by vertically spaced support and guide means in the machine to prevent any variation in the desired straight position of the log as it moves along a prescribed longitudinal path, during which time various subsequent operations are performed thereon so as ultimately to achieve the formation of preferably four boards of certain sizes, depending upon the diameter of the log being processed, and a cant having four sides, all disposed at 90° with respect to each other and preferably square, the formation of such boards and cants being undertaken with minimum consumption of time, completely automatically and with minimum power requirements by the machine comprising the present invention and described in detail hereinafter.

It will be understood that the machine includes duplicate sets, disposed in relative upper and lower positions and longitudinally spaced within the machine for purposes of forming said boards and cant, the upper set of processing elements being movable by an upper frame toward and from the lower set supported by a lower or base frame for purposes of adapting the machine to logs of certain sizes in order to produce maximum amounts of useful lumber products from the logs. The size of the cant is of primary interest in the present invention and said size is determined by the diagonal dimension between the upper and lower cant corners 28 and 30. Following the formation of said cant corners 28 and 30 by means of the pairs of notches just described, the next operation is to remove, preferably by chipping operation, partial upper slab sections 32 and 34 which respectively are on opposite sides of a vertical plane passing through the upper and lower corners 28 and 30 for purposes of forming flat surfaces 36 and 38, which are disposed at a right angle with respect to each other and also are at an angle of 45° to a vertical plane, for example, passing through the upper and lower corners 28 and 30. In addition, such chipping operation which forms the surfaces 36 and 38 also includes means to form a pair of opposite side notches 40 and 42, which as will be seen, define one surface of side cant corners 44 and 46, shown respectively in FIGS. D–F.

While still guided by the upper and lower cant corners 28 and 30, the log proceeds to subsequent chipping units which remove lower partial slab sections 48 and 50, shown in the lower portion of the log 10 in FIG. D, respectively at opposite sides of a vertical plane passing through the upper and lower corners 28 and 30, said slab sections being indicated by stippling in FIG. D, and in addition, the same chipping units also form further side notches 52 and 54, shown by stippling, for purposes of completing the formation of the side cant corners 44 and 46. From FIG. D, it will be seen that the revised log 10 now includes a cant 56, shown in FIG. F, to which, as shown in FIG. D, four extra flat projections 58 are formed which are integral with the cant 56. Said projections comprising a pair of lower boards 60 and 62 which are removed from the cant 56 by saws at a lower sawing station, the separated boards being shown in FIG. E, and subsequently, as shown in FIG. F, a pair of upper boards 64' and 66' are removed from the cant 56 by additional saws downstream from those which remove boards 60 and 62 from the cant, thereby producing four similar boards of useful size, all of which are similar, but the sizes thereof between successive logs of different sizes will vary in accordance with the diameters of the logs, as can be visualized from FIGS. A–F.

It also will be understood that according to conventional timber sawing practice, the four boards removed from the square cant normally would comprise portions of slabs and in many wasteful types of operations, the slabs are sawed in lengths for fire wood, etc., but by means of the present invention, are converted into useful boards incident to the cant being formed and during only a single pass of the log through the machine. Also, in accordance with the present invention, the chipping means, described hereinafter, by which the partial cant section and the pairs of grooves are formed in the log, are of such nature that they produce chips which are highly suitable for pulping operations, whereby substantially no waste products result from the processing of a log by the machine comprising the present invention.

Figure 3:
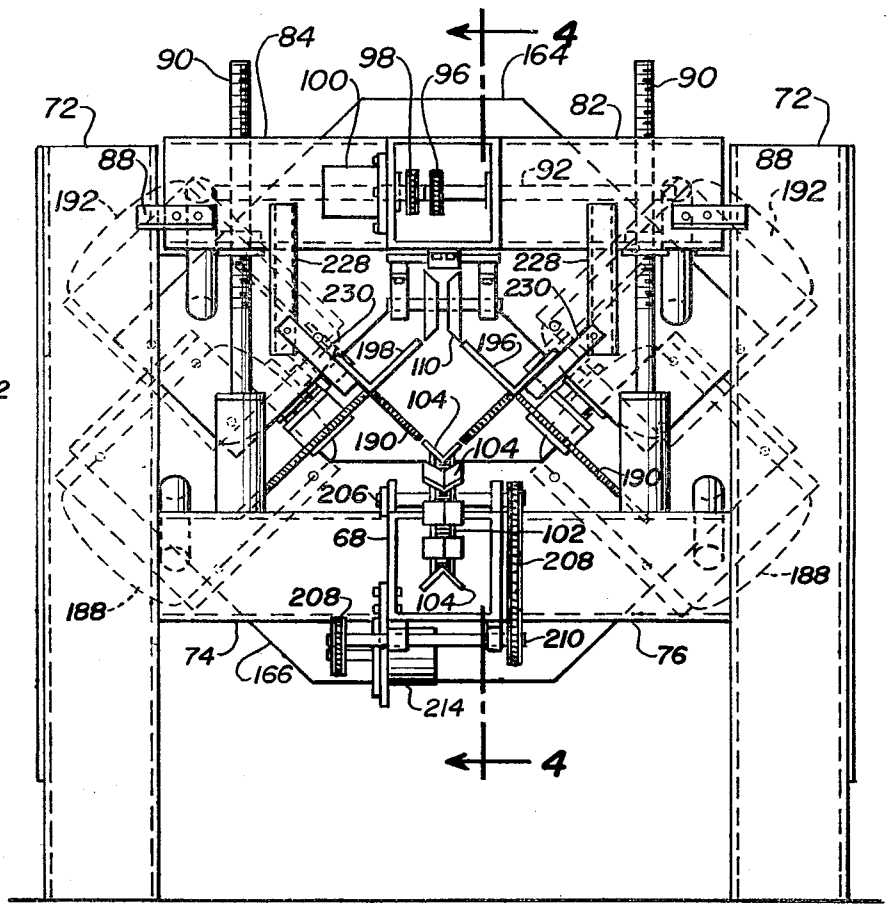
FIG. 3 is a vertical elevation showing the discharge end of the machine as seen on the line 3—3 of FIG. 1.
Figure 4:
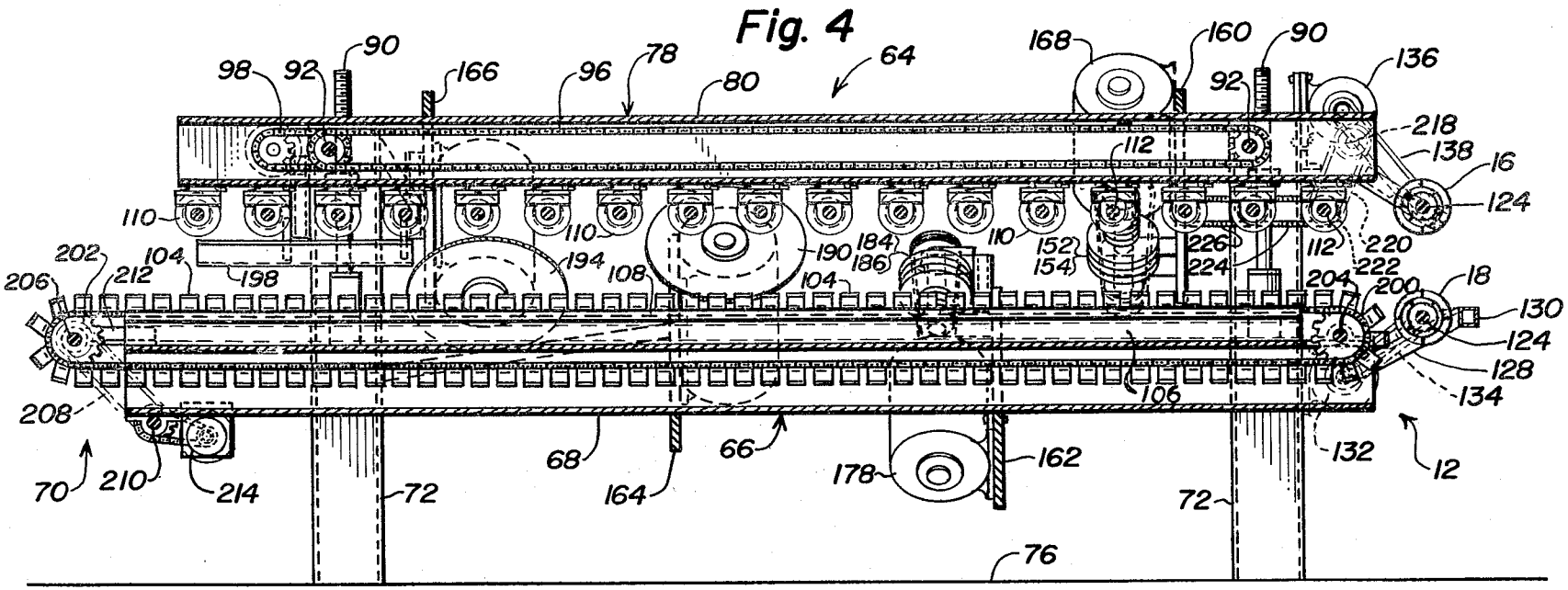
FIG. 4 is a vertical sectional view of the machine taken substantially along the central axis shown in FIG. 1 and showing from the interior of the machine, in particular, details of the chipping and cutting mechanism, as well as supporting and feeding means arranged in the preferred order of sequence, as seen on the line 4—4 of FIG. 3.

Referring particularly to FIGS. 1 and 4, the machine 64 comprises a very rigid and sturdy elongated base frame 66 comprising a central hollow tubular beam 68 extending from the inlet 12 of the machine to the discharge end 70 thereof. A plurality of so-called vertical corner posts 72, which preferably are square steel tubes of substantial size, such as of the order of 8 or 12 inches in cross-section, support the central tubular beam 68 by means of a plurality of end frame members 74 and 76 which extend respectively between opposite sides of the beam 68 and the inner surfaces of the vertical posts 72, as best shown in FIGS. 1—3, 7 and 8. Connection preferably is effected by welding, and as shown in FIG. 4, lower portions of the corner posts 72 extend vertically downward to a supporting surface 76, such as a factory floor.

The machine also includes an upper frame 78, which is substantially co-extensive with the lower base frame 66, as clearly shown in FIG. 4, and is a longitudinal sectional view through the center of the plan view, shown in FIG. 1. As in the base frame, the upper frame 78 is provided with a central tubular beam 80 which is similar to beam 68 of the base frame and projecting from opposite sides thereof adjacent the opposite ends are a plurality of transverse end frame members 82 and 84 which, as shown best in FIG. 1, have the outer ends thereof slightly spaced from the inner surfaces of the corner posts 72 and suitable bearing blocks 86 and plates 88 respectively slidably engage the inner surfaces and outermost end surfaces of the corner posts 72 to insure accurate guiding of the upper frame with respect to the base frame for purposes of accommodating the machine to process circular logs of a very substantial range of different diameters. By way of example, without restriction thereto, the machine has been built in accordance with the description set forth herein that has been capable of producing cants approximately five inches square when the upper frame was disposed in a lower position thereof and, when raised to an upper position, produced a cant sixteen and one-half inches square, both of said productions referred to also including four boards in each situation sawed from the log incident to producing such cants.

Figure 2:
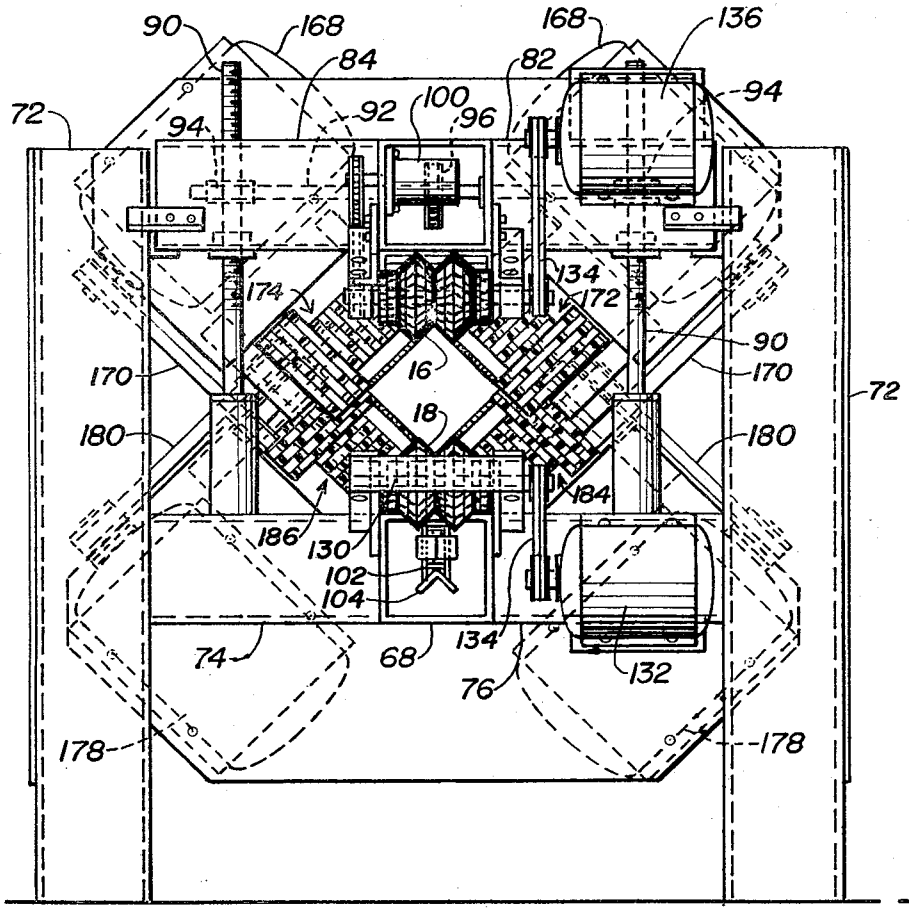
FIG. 2 is a vertical front end elevation showing the inlet of the machine as seen on the line 2—2 of FIG. 1.

Vertical adjustment of the upper frame with respect to the lower frame is accomplished by relatively simple mechanism in the form of similar screw jacks 90, best shown in FIGS. 1–4, which, as shown particularly in FIGS. 2 and 3, extend upward from the upper surfaces of the end frame member 74 and 76 and are rotatably supported for movement about the axes thereof by means commonly operated to similarly rotate all of the jacks simultaneously, such rotating means being illustrated in the form of a pair of transverse shafts 92, which as shown in FIGS. 2 and 3, are preferably disposed within the end frame members 82 and 84, the opposite ends of the shafts 92 having worms 94 thereon which engage mating threads on the screw jacks 90 for purposes of rotating the latter when the shafts 92 are rotated. Rotation of the shafts 92 is accomplished simultaneously by means of sprocket gears being fixed thereto intermediately of the ends thereof and around which an elongated endless sprocket chain 96 extends, as shown in FIG. 4, said chain being driven by a relatively short sprocket chain 98 which extends commonly around another sprocket gear fixed to one shaft 92 and the sprocket gear on the outer end of power means preferably comprising a hydraulic motor 100, shown in FIGS. 1–3. The sprocket chains 96 and 98 are protected since the same are enclosed within the central beam 80 of the upper frame 78.

The base frame 66 employs the central beam 68 to support an endless flexible conveyor 102 of a very sturdy nature comprising connected links to certain of which, such as alternate links, support means are connected in the form of V-shaped elements 104. The lower course or span of the conveyor extends through the central beam 68 of the base frame as clearly shown in FIG. 4 and mounted on top of the beam 68, centrally thereof, is an additional smaller tubular beam 106 affixed to support a channel 108, shown in FIGS. 4, 7 and 8 along which the upper span of the conveyor chain 102 slides. The V-shaped support elements 104 have sides disposed at a right angle to each other so as to be complementary to the shape of the lower cant corners 30 for purposes of supporting the log from its introduction into the machine at the inlet end 12 thereof as the log is delivered thereto by the feed conveyor 14, for example.

Figure 14:
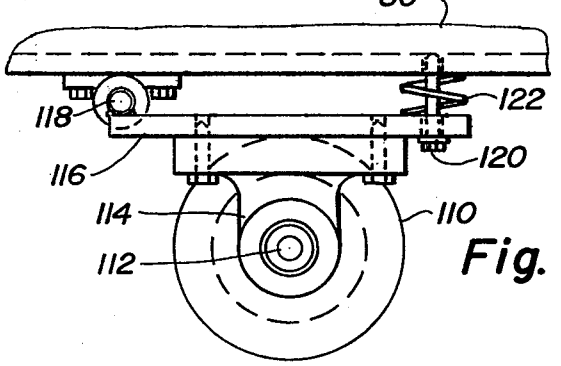

Cooperating with the conveyor 102 and the V-shaped elements 104 thereon for purposes of additionally supporting, positioning, and feeding the log 10 through the machine are additional guide means in the form of grooved rollers 110, one preferred embodiment of which is shown in detail in FIG. 14. As can be seen from said figure, the grooved rollers 110, which actually comprise a pair of each as shown for example in FIGS. 3, and 5—8, are each supported upon a transverse shaft 112, the ends of which are supported respectively in transversely-spaced anti-friction bearings 114 mounted upon a plate 116, which is rotatably connected at one end by means of a bearing pintle 118 secured by bolts to the lower surface of the upper central beam 80 and the opposite end of plate 116 is limited in downward movement by the head of bolt 120, which is threaded into the lower surface of the upper central beam 80 and a compression spring 122 surrounds the bolt for purposes of urging the grooved rollers 110 firmly into engagement with the upper cant corner 28 which is ridge-like and extends for the full length of the log, as in regard to the lower cant corner 30, diametrically opposite the same. Accordingly, each log is accurately and precisely supported and held at upper and lower portions thereof comprising the opposite cant corners 28 and 30 for the full, one-shot passage through the machine, during which time all of the formations shown in FIGS. A—F are performed upon the log, ultimately to form the cant 56 and the boards 60, 62, 64' and 66'. Such support and guide means enable all of the operations to be performed during said central passage through the machine, regardless of the size of the log within reasonable ranges, such as those set forth above for exemplary purposes.

Figure 11:
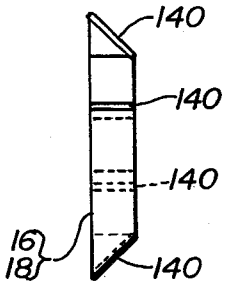
FIG. 11 is an edge view of the exemplary cutter shown in FIG. 10 and illustrating the 45° disposition of the cutting tips of the cutter.
Figure 10:
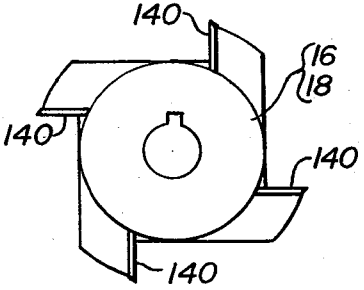
FIG. 10 is a side elevation of one of the cutters of the assembly thereof shown in FIG. 9 and having end surfaces on the teeth disposed at an angle of 45° to the axis of the cutter.

The upper and lower cant corners 28 and 30 are formed upon the log by the compound upper and lower chipping cutters 16 and 18, which are shown in detail in FIGS. 9—11, wherein it will be seen that said compound cutters are composed of gangs of cutters of different shapes securely mounted and locked upon transverse arbors 124. The lower chipping cutter 18 is supported within a rectangular frame 126 comprising parallel side members 128 and an end member 130, the side members 128 supporting appropriate bearings for the opposite ends of the arbor 124 on the cutter 18. The cutter and arbor are driven by an electric motor 132 or other appropriate power means, such as a hydraulic motor, if desired, said motor operating a suitable belt or sprocket chain 134, extending between the drive sheave of the motor and corresponding sheave on arbor 124.

The upper compound chipping cutter 16 is also provided with an arbor 124, as shown in FIGS. 1 and 4, and is driven by electric motor 136, or other type of motor if desired, said motor being connected to a sheave on arbor 124 by a belt or sprocket chain 138, as desired, which extends around appropriate sheaves or sprockets gears on the motor shaft and arbor 124.

From FIGS. 2 and 4, in particular, it will be seen that the compound upper and lower chipping cutters 16 and 18 are positioned in vertical alignment respectively to engage upper and lower surface portions of the log 10 to form the respective upper and lower cant corners 28 and 30 and thereby determine the diagonal dimension of a cant to be formed by the machine with the four surfaces thereof ultimately in planes each at 45° to either the horizontal or vertical axes of the macine, as well as of the path of movement through the machine determined by the conveyor 102. Particularly for purposes of enabling the machine to process with equal facility logs of both relatively hard and soft wood, all of the chipping cutters which form the upper and lower cutters 16 and 18, as well as those described hereinafter, and also in regard to the saws described hereinafter, the teeth of all of which chipping cutters and saws are provided with tungsten carbide cutting tips, such as the tips 140 on the gang of individual cutters of either the same or different diameters, as shown, for example, in FIG. 9. The groups of cutters shown in FIG. 9 immediately on opposite sides of the central line 142 thereof are selected and mounted upon the arbor 124 so as to provide a circumferential outline of operating surface which forms a V-shaped notch 144, the opposite sides of which are at a right angle to each other. Said inner surfaces terminate at peaks 146 and from there the surfaces extend angularly toward the axis of arbor 124 with surfaces that are at a right angle to the inner surfaces that form the V-shaped notch 144. The latter notch respectively in the upper and lower cutters 16 and 18 forms the upper and lower cant corners 28 and 30, while the peaks 146 of the cutters form the depth of the pairs of notches 20, 22, 24 and 26, shown particularly in FIGS. B–D in the upper and lower surface portions of the log.

Especially for purposes of removing unusual projections or other excess uneven surfaces in a log adjacent the cant corners 28 and 30, the gang of cutters 16 and 18, such as shown in FIG. 9, additionally have respectively on the outer end portions thereof, groups 148 of chipping cutters of uniform diameter and preferably multi-toothed, such as shown, for example, in FIG. 10, whereby the outline of cutting surface formed by the groups 148 is cylindrical and capable of removing excess wood beyond the desired shapes of grooves 20, 22, 24 and 26. Also, it will be understood that the teeth of adjacent cutters in the entire assembly, shown in FIG. 9, are staggered with relation to each other. Further, the cutters forming the angularly-related surfaces of the gang shown in FIG. 9 have angular tips thereon at 45° to the axis of the cutter, such as shown in edge view in FIG. 11, and all of said cutters of different diameters are arranged and selected suitably to form smooth angularly-related cut surfaces, whereby the views of exemplary cutters shown respectively in FIGS. 10 and 11 are characteristic of the individual chipping cutters as far as actual shape is concerned.

Figure 13:
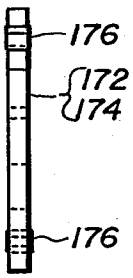
FIG. 13 is an edge view of the exemplary cutters shown in FIG. 12 to show particularly the transverse edges of the cutting tips of the blade.
Figure 12:
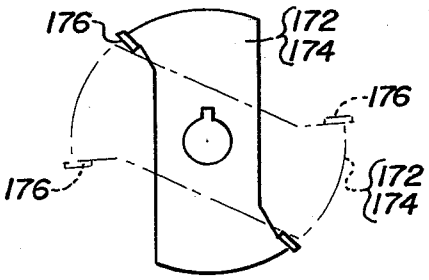
FIG. 12 is a side elevation of an exemplary chipping cutter of which a gang thereof are mounted on an arbor for purposes of forming a flat surface at a selected location upon a log while passing through the machine, said figure also showing in phantom an additional similar blade disposed at an angle to the blade shown in full lines to represent the preferred staggered location of the cutters with respect to each other.
Figure 5:
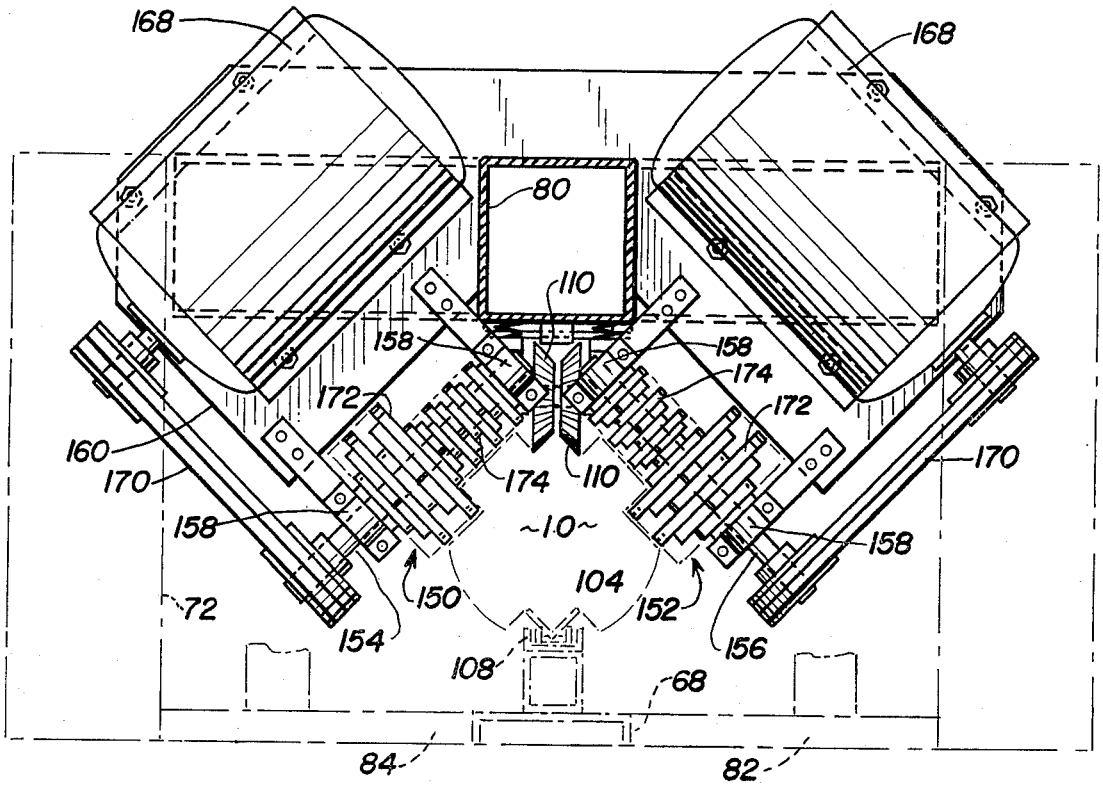
FIG. 5 is a vertical sectional view of the machine shown in FIG. 1 as seen on the line 5—5 thereof, looking in the direction of the inlet end thereof, said view showing in full lines upper chipping mechanism and drive means therefor, and in phantom, fragmentarily showing other portions of the machine.

After the formation of the pairs of grooves 20, 22, 24 and 26, respectively in the upper and lower surfaces of a log, have been formed by the cutters 16 and 18 to form the upper and lower cant corners 28 and 30, the log then proceeds to four stations in sequence, exemplary indications thereof being shown in FIG. 1. At station 1, shown in vertical elevation in FIG. 5, the log 10 is first engaged by two sets of chipping cutters 150 and 152, which respectively remove the partial upper slab sections 32 and 34 from the log 10 and also form the side notches 40 and 42, such as shown clearly in FIG. C. The sets of chipping cutters 150 and 152 are composed of gangs of chipping cutters of the type, for example, shown in FIGS. 12 and 13, which are mounted upon arbors 154 and 156, the opposite ends of which respectively are supported by bearings 158, which are connected to the first of a series of supplementary frame members 160, 162, 164 and 166, which are clearly shown in edge view in FIG. 4, the same primarily comprising metal plates of suitable thickness which are supported by and connected alternatively to the central beams 80 and 68 respectively of the upper and base frames, whereby opposite ends thereof respectively extend from opposite sides of said central beam, not only to support the bearings for the chipping cutters respectively on the upper and base frames, but also the motors which drive the same individually, but in unison. Referring to FIG. 5, it will be seen that similar motors 168, preferably electric, are each connected to opposite end portions of the frame member 160, which through the medium of belts 170, drive the arbors 154 and 156 to effect the formation shown in FIG. C.

The chipping cutters in the sets 150 and 152 preferably are of two different diameters respectively to provide two sections in the cutter, one section comprising the uppermost section shown in FIG. 5 and are of a smaller diameter than the lower section, but in each section, each of the chipping cutters 172 respectively of larger and smaller diameters each having two teeth extending diametrically from each other and tipped with tungsten carbide cutting tips 176, respectively are staggered in the mounting thereof upon the arbors but the outline of the cutting surfaces of said chipping cutters being cylindrical and of different diameters relative to the two sections one each cutter.

Figure 6:
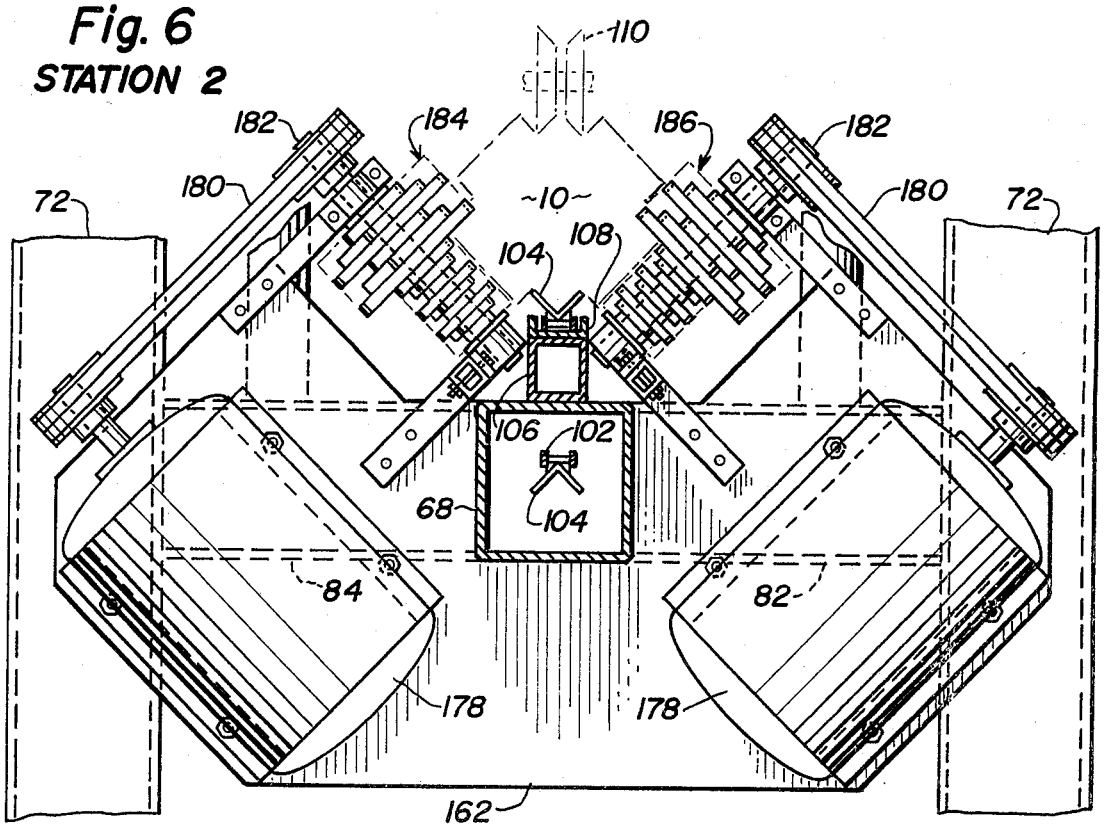
FIG. 6 is a view similar to FIG. 5, but showing in full lines the lower chipping mechanism as seen on the line 6—6 of FIG. 1, portions of the frame of the machine being illustrated only fragmentarily.

At station 2, shown in FIG. 6, for example, the base frame supports upon its central beam 68, the supplemental plate-like frame member 162 for purposes of supporting on opposite end portions thereof, motors 178, which preferably are electric, and through the medium of belts 180, drive the arbors 182 of the lower sets of chipping cutters 184 and 186, each of which have two sections of different diameters and are otherwise the same as the sets of cutters 150 and 152 on the upper frame. In all instances relative to both chipping cutters and saws, the teeth thereon move in cutting direction against the feeding movement of the logs so as to make clean cuts and produce satisfactory chips.

Figure 7:
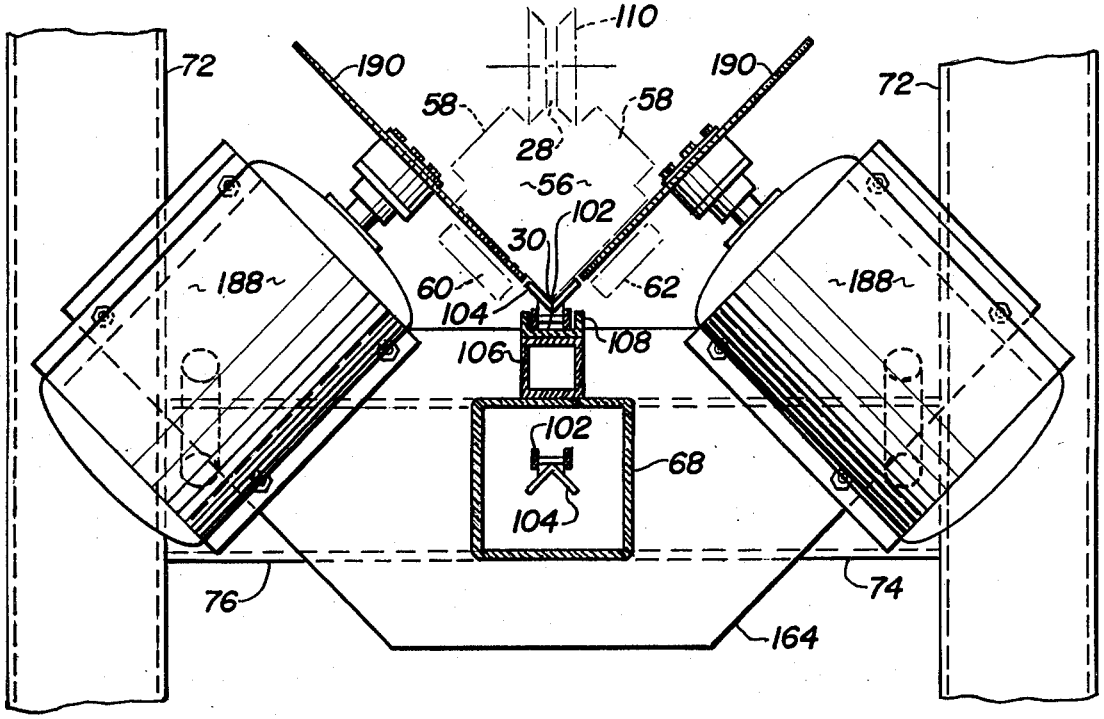
FIG. 7 is a vertical sectional elevation as seen on the line 7—7 of FIG. 1 and showing sawing mechahism shown in relation to the conveyor of the machine and parts of the supporting frame of the machine being illustrated only fragmentarily.

At station 3, which is immediately downstream from station 2, comprising the second chipping station, the first sawing station is supported upon transverse supplemental frame 164 which is connected to the central beam 68 of base frame 66 and extends in opposite directions therefrom for purposes of respectively supporting motors 188 to the shafts of which are affixed similar saws 190 which, as shown in FIGS. 3 and 7, are at 90° with respect to each other and also are in planes coincident with the opposite sides of V-shaped elements 104 which receive the lower cant corners 30 to support said cant. When the boards 60 and 62 have been sawed from the log by the saws 190, and by which time the cant is rapidly approaching final shape and size, the boards fall by gravity onto suitable receiving means, not shown, for purposes of rapidly removing the boards from the machine and clearing the way for additional boards to be sawed from subsequently processed logs.

Figure 8:
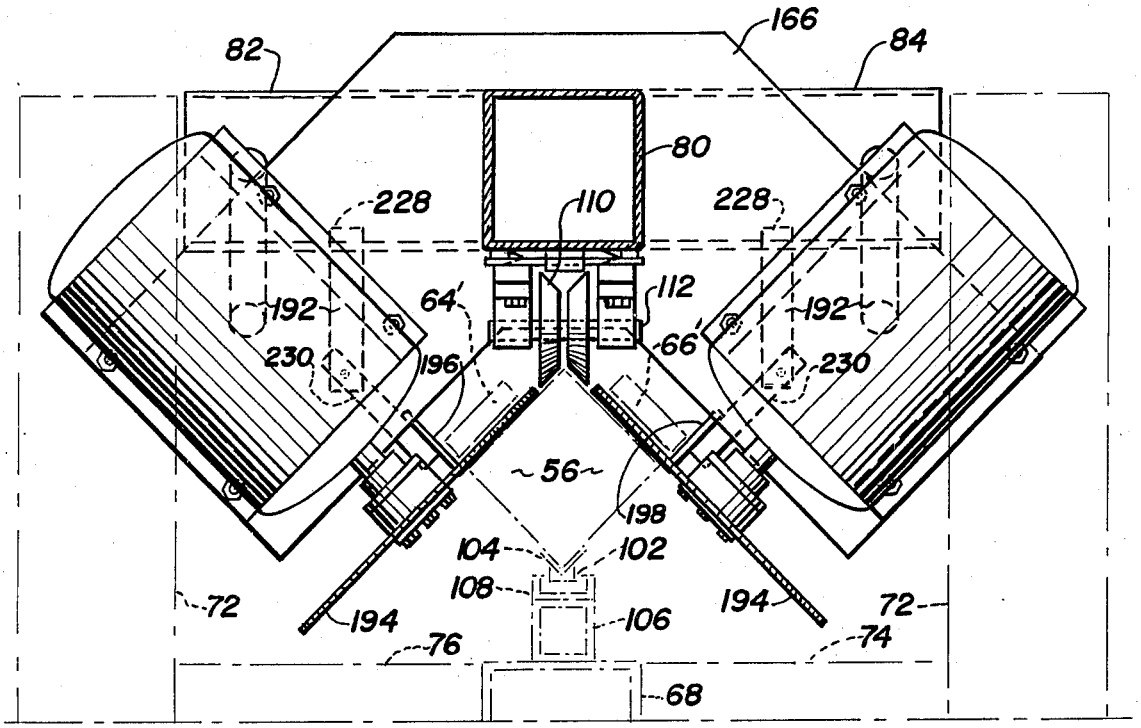
FIG. 8 is a vertical sectional view taken on the line 8—8 of FIG. 1 and showing upper sawing means illustrated in relation to a fragmentary portion of the conveyor in conjunction with the upper guiding mechanism, portions of the supporting frame being shown only fragmentarily in phantom.

From station 3, the nearly completed cant passes to station 4, details of which are best shown in FIG. 8, and in which supplemental frame member 166 is shown secured to and extending downward from opposite sides of central beam 80 of the upper frame, said frame being spaced sufficient downstream from supplemental frame members 164 at station 3 to prevent any interference between the saws of the respective stations due to the fact that station 4 is arranged to saw the upper boards 64' and 66', shown in FIG. F, from the upper portion of the log which then becomes finished cant 56. To saw the boards 64' and 66' from the log, supplemental frame 166 supports a pair of motors 192 respectively at opposite sides of the longitudinal axis of the frame, said motors being disposed in angles of 45° to the vertical central plane of the machine and similar saw blades 194, preferably of a size similar to the blades 190 at station 3, are fixed to the shafts of motors 192 for purposes of sawing the boards 64' and 66' from the upper portion of the log and thereby complete the formation of cant 56 which, as shown in FIG. 8, is square in cross-section, due to the fact that the saw blades 194 are in an angle of 90° with respect to each other. In other that the boards 64' and 66' which are removed from the upper half of the log will not interfere with any items moving through or being produced by the machine, there is provided at station 4, a pair of angular guides 196 and 198, which extend downstream from the supplemental frame member 166, as clearly shown in FIGS. 1 and 4. Also, by referring to FIG. 3, it will be seen that the angular guides 196 and 198 have side flanges which are disposed at 90° to each other and the flanges which are nearest the central vertical axis of the machine are in the same plane as the saws 194, whereby the angular guides are accurately positioned to receive respectively the upper boards 64' and 66' as they are being sawed from the log and finally, to conduct them beyond the discharge end 70 of the machine, as viewed in FIG. 4. Preferably, suitable conveying means, such as conveyors, guides, or otherwise, not shown, are to be provided so as to extend from the discharge end 70 of the machine and continuously conduct the severed boards from the machine as, indeed, still other removing means, not shown, will convey the completed cant 56 from the discharge end 70 of the machine in order to clear the machine for passage of the next log therethrough for the formation of the succeeding cant.

Referring to FIGS. 1 and 4, the drive means for the conveyor 102 are illustrated. Opposite ends of the conveyor respectively are supported by cogs 200 and 202 mounted on shafts 204 and 206, cog 202 being the driving cog, which is powered by a belt or sprocket chain 208 which extends respectively around sheaves or sprocket gears fixed to shafts 206 and 210. Shaft 206 is supported at its opposite ends by bearings respectively carried by the outer ends of frame plates 212 which respectively are fixed to the projecting end of central beam 68 of the base frame 66, said end projecting beyond the corresponding end of the upper central beam 80 of the upper frame as also can be seen from FIG. 4. The shaft 210 is driven by appropriate power means, such as hydraulic motor 214, the shaft of which is provided with a sprocket gear around which sprocket chain 216 extends and also extends around a corresponding sprocket gear on shaft 210, for purposes of providing the power means for moving the upper span of the conveyor 102 between the inlet end 12 and the discharge end 70 of the machine, thereby carrying a log for a single passage through the machine and effect the conversion thereof into four boards of useful lumber and a cant having four sides at right angles to each other, preferably square.

While the additional guide members comprising grooved rollers 110 effect compression upon the upper cant corner 28 as it passes through the machine from the inlet end thereof, further driving force can be applied to the log by means of having a limited number of the grooved rollers 110 adjacent the inlet end 12 of the machine driven, rather than being idlers. Means to drive the same are illustrated in FIGS. 1 and 4. In FIG. 4, it will be seen that interiorly of the end of the central beam 80 adjacent the inlet end of the machine is a hydraulic motor 218 and the shaft thereof extends through a hole in one sidewall of the beam 80 for purposes of driving a belt or sprocket chain 220 which extends around sheaves or sprocket gears respectively mounted on the motor shaft and sheave or sprocket gear 222, shown adjacent the right-hand end of FIGS. 1 and 4. By means of additional chains or sprocket gears 224 and 226 fixed to the outer ends of the shafts 112 of the limited number of grooved rollers 110 adjacent the inlet end 12 of the machine, as shown particularly in FIGS. 1 and 4, especially FIG. 4. Such additional drive means primarily is supplementary and, depending upon the nature and power of the feeding conveyor, not shown, for delivering logs to the inlet end 12 of the machine, it may not be necessary to furnish the additional driving means in the form of said limited number of grooved rollers 110.

The angular guides 196 and 198 are supported by any suitable means, such as the structure shown in FIGS. 1, 3 and 8, comprising pairs of depending members 228, one pair of which are secured at the upper ends thereof to the supplemental frame member 164 and the other pair is secured to the end frame members 82 and 84 as shown especially in FIG. 1. Additional supporting members 230 are connected to the lower ends of the depending members 228 and extend angularly downward and inward toward the central axis of the machine for purposes of underlying and being affixed to the lower surfaces of the outermost flanges of the angular guides 196 and 198.

In addition to providing guide means for the log while traversing the entire length of the machine by means of forming the upper and lower cant corners 28 and 30 initially in the log respectively for engagement by the upper guide means 110 comprising the grooved rollers and the V-shaped support elements 104 on the conveyor, as well as the cutting and notching means to form the flat projections 58 respectively on the four sides of the log and the formation of the side cant corners 44 and 46, it will be seen particularly from FIGS. D–F, that the width of the boards 60 and 62 to be sawed from the lower half of the log and the upper boards 64' and 66' to be sawed from the upper half thereof is less than the width of the four sides of the cants 56, whereby the diameter of the saw blades to remove said boards from the four sides of the cant need not be as great a diameter as otherwise would be required if the width of the boards were equal to the length of the four sides of the cant, whereby the formation of the pairs of grooves respectively on the upper and lower surfaces on opposite sides of the log serves a further purpose and maximizes the products to be formed from logs within the range of exemplary diameters referred to above, in addition to the fact that the partial slab section of the log and the wood which is removed from the pairs of adjacent grooves is of a chip and sliver nature suitable for use in pulping processes, whereby logs are transformed into useful lumber products and other material serving as industrial products of value, as distinguished from the products formed by conventional lumber methods which include substantial amounts of waste in the form of sawdust which is unsuitable for pulping operation.

In FIG. 4, the preliminary chipping cutters 16 and 18 are shown in vertical alignment but, especially to effect initial positioning engagement of logs with the conveyor 102, particularly when handling large diameter logs, it is preferred that the lower chipping cutter 18 be spaced outwardly beyond the upper chipping cutter 16 a limited distance such as a foot or more. Also, at the discharge end of the machine, particularly in regard to large size cants, the discharge end of the conveyor 102 extends a short distance farther than shown in FIG. 4, such as of the order of several feet.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A machine to produce from round logs a cant of four sides at right angles to each other and comprising in combination, (a) an elongated base frame having log inlet means at one end and cant discharge means at the opposite end, (b) an elongated flexible conveyor extending along said frame between said inlet and discharge means and having an upper span defining a path of movement along said frame, (c) power means to drive said conveyor uni-directionally, (d) means adjacent said inlet end of said frame operable to form respectively on the upper and lower surfaces of a log, pairs of adjacent grooves and each pair defining therebetween a right-angled rib-like cant corner extending along the upper and lower portions of the cant to be produced by said machine, (e) support means on said conveyor complementary in cross-section to said cant corner in the bottom surface of said log to accurately guide and support said log along said path of movement, (f) additional guide means parallel to said conveyor and spaced thereabove a distance substantially equal to the diagonal cross-sectional dimension of the cant to be formed by said machine and having a cross-sectional shape complementary to and engaging said cant corner in the upper surface of said log and cooperating with said support means on said conveyor to firmly engage said log for the entire movement thereof along said path of movement, and (g) cutting means spaced along said path of movement sequentially to remove slab areas and sections respectively from the opposite sides of the upper and lower portions of said log to form flat sides on said cant while said log moves only longitudinally along said path in fixed axial position from the inlet to the discharge ends of said frame as guided by said conveyor and said additional guide means in engagement with the lower and upper cant corners.

2. The machine according to claim 1 in which said conveyor is a link chain and said support means on said conveyor comprising elements attached to at least some of the links of said chain in close frequency having grooves in the outermost surfaces complementary to the lower corner of the cant being formed and said additional guide means above said conveyor firmly positioning said lower corner of the cant in said grooves for continuous passage of the log along said path of movement.

3. The machine according to claim 2 in which said additional guide means comprise rollers each having an annular groove complementary to said upper corner of the cant being formed, and said machine further including means to urge said grooved rollers firmly against said upper corner of said cant being formed.

4. The machine according to claim 3 further including drive means connected to at least certain of said grooved rollers and operable to rotate the same in a direction to supplement the feeding of a log along said path of movement by said conveyor.

5. The machine according to claim 1 in which said means adjacent the inlet end of said base frame to form pairs of adjacent grooves in the upper and lower surfaces of a log respectively each comprise compound rotary chipping cutters each having a pair of side-by-side annular ridges each having side surfaces at a right angle to each other meeting at the peak of the ridges and said surfaces having transverse chipping teeth thereon and power means to rotate said cutters.

6. The machine according to claim 1 in which said additional guide means are mounted upon an auxiliary frame substantially coextensive in length with and above said elongated base frame, means supporting said auxiliary frame at spaced locations for adjustable positioning toward and from said elongated base frame, and said additional guide means comprising a series of pressure and guide rollers at least some of which are complementary to the corner of a cant on the upper surface of a log being formed into a cant by passage through said machine.

7. The machine according to claim 6 in which said means to support said auxiliary frame at spaced locations comprise similar screw jacks located at opposite sides of and spaced longitudinally along said frames, and power means interconnected to said jacks and operable to rotate the same simultaneously in directions selectively to raise and lower said auxiliary frame relative to said elongated frame.

8. The machine according to claim 1 in which said cutting means spaced along said path of movement include two pairs of rotary saws supported with the saws of each pair at a right angle to each other and said pairs respectively being spaced longitudinally along said path of movement, the planes of said pairs of saws respectively being positioned at 45° to and on opposite sides of a vertical plane longitudinally bisecting said path of movement, one of said pairs of saws being positioned to intersect the upper portion of said log and the other pair being positioned to intersect the lower portion of said log, and power means connected to said saws and operable sequentially to saw said log automatically to form during a single passage through said machine four sides upon said cant at right angles to each other while said log is supported and guided during the entire movement along said path solely by said conveyor and additional guide means engaging respectively said lower and upper cant corners initially formed on said log.

9. The machine according to claim 8 further including an auxiliary frame substantially coextensive in length with said elongated base frame, means supporting said auxiliary frame above said elongated base frame for vertical adjustment toward and from the same, said auxiliary frame supporting said additional guide means engageable with the upper cant corner on a log while passing through said machine, and means on said auxiliary frame supporting said one of said pairs of saws adapted and positioned to intersect and saw the upper portion of a log as aforesaid to form the upper two surfaces upon said cant and the other pairs of saws being supported by said elongated base frame to intersect the lower portion of said log to form the two surfaces on the lower portion of said cant.

10. The machine according to claim 9 in which said cutting means spaced along said path of movement further include chipping means supported respectively by said auxiliary and base frames and longitudinally spaced along said frames relative to each other and said saws and operable to remove at least portions of said slab areas and sections from said log.

11. The machine according to claim 8 further including rotary chipping members rotatable about axes parallel to the planes of said rotary saws and positioned upstream along said path of movement relative to said rotary saws and operable to remove from said log substantial portions of said slab areas of said log generally to produce relatively flat surfaces on said log respectively parallel to said rotary saws but spaced radially outward from the ultimate outer surfaces of the cant to be formed by said machine, and said rotary saws sawing said log as aforesaid to remove the excess portions of said log below the surfaces formed by said chipping members to produce the final outer surfaces on the four sides of said cant and simultaneously form boards.

12. The machine according to claim 1 further including additional cutting means positioned downstream from said means to form adjacent grooves in the upper and lower surfaces of said log and operable to form in the opposite sides of said log pairs of adjacent grooves similar to those in said upper and lower surfaces, whereby the opposite outermost sides of both said upper and lower pairs of grooves and said pairs of grooves in the opposite sides of said log respectively define therebetween opposite side edge surfaces of four boards integral with the cant of which the corners are formed respectively between each pair of grooves and said side edge surfaces of said four boards being perpendicular to the outer surfaces of said log formed by said cutting means, a first pair of rotary saws disposed at a right angle to each other and spaced longitudinally along said path of movement and positioned respectively at 45° to a vertical plane longitudinally bisecting said path of movement and in planes respectively between the upper cant corner and the cant corners at the sides of said log and operable to sever two top boards from the upper half of said log and also form two upper sides of said cant respectively at opposite sides of said vertical plane, a second pair of rotary saws respectively positioned at 45° to said vertical plane and spaced longitudinally along said path of movement and in planes respectively between the lower cant corner on said log and the corners at the sides of said log and operable to sever two bottom boards from the lower half of said log and also form two lower sides of said cant respectively at opposite sides of said vertical plane, and power means operable to drive said pairs of saws, whereby a cant having sides at right angles and four boards are formed automatically during a single passage of a log through the machine while said log is guided entirely between said conveyor and additional guide means continuously.

13. The machine according to claim 12 in which said additional cutting means comprise a plurality of elongated chipping cutters supported upon said frame means for rotation about axes respectively parallel to the planes of said rotary saws and upstream therefrom along said path of movement, said chipping cutters having peripheral teeth adapted to form wood slivers and chips suitable for paper pulp production, and said machine including additional power means connected to said chipping cutters to rotate the same to remove said slab areas and sections of said log prior to said saws engaging said log.

14. The machine according to claim 13 in which said chipping cutters are stepped type and include an elongated section of uniform diameter respectively to produce outer flat surfaces of said four boards initially integral with said cant prior to said saws removing said boards from the cant, and said chipping cutters including on one end a section of chipping teeth of greater diameter than said elongated section of uniform diameter and operable respectively to form one of said pairs of grooves respectively in the opposite sides of said log, whereby said end sections of said chipping cutters on successively positioned chipping cutters cooperate to form pairs of grooves on the opposite sides of said log to define said side edges of the boards respectively on opposite sides of the upper and lower portions of said logs.

15. The machine according to claim 1 in which said means adjacent said inlet end of said frame to form said grooves comprises a similar pair of chipping cutters each including an arbor supported substantially horizontally and power means to rotate the same, said arbors being vertically spaced, and a gang of chipping cutters similarly mounted and clamped upon said arbors, said chipping cutters each having a number of circumferentially spaced teeth extending radially even distances from a central mounting hole and each tooth having similar tungsten carbide tips affixed thereto, the peripheral shapes and diameters of said teeth being substantially at a 45° angle to the axis of the cutters and the diameters of adjacent cutters varying respectively to provide an assembly in which the overall combined shape is a double pair of cones each sloping from the axis toward an outer ridge with the opposite sides at a right angle to each other and the double pair thereof defining therebetween a groove having sides at a right angle to each other and adapted to form said aforementioned pairs of adjacent grooves in a log defining therebetween a right angled rib comprising a corner of a cant, whereby said chipping cutters are adapted readily to cut hardwood equally as well as softwood and grades in between.

16. The machine according to claim 15 further including upon said arbor axially outward from one or both of the opposite ends of said assemblies of said cutters which form said double pairs of cones one or more additional toothed cutters having teeth of uniform diameters to provide cutters adapted to outline cylindrical cutting means and the teeth of adjacent cutters being staggered relative to each other and operable to remove from a log excess wood laterally beyond said pairs of grooves.

17. The machine according to claim 1 in which said cutting means spaced along said path of movement to remove slab areas of a log to form flat sides thereon comprise a plurality of similar arbors respectively supported upon said machine at opposite sides of and above and below each other and in longitudinally spaced relationship along said path of movement respectively to cut flat surfaces from the upper and lower portions of a log at opposite sides of a vertical plane longitudinally bisecting said conveyor, and a similar series of chipping cutters mounted upon said arbors and locked thereto for rotation therewith, one portion of said series being of a uniform diameter lesser than that of the cutters of a second portion thereof and at one end of said first portion, the cutting teeth of the cutters of both portions being circumferentially spaced and radial and provided with tungsten carbide tips, the teeth of adjacent cutters being staggered relative to each other, and the teeth of both portions of said series respectively being cylindrical in outline and the portion of smaller diameter being positioned to cut said flat surfaces upon a log respectively extending outward from the pairs of grooves in said upper and lower surfaces of a log and at an angle toward a horizontal plane bisecting said log, and the cutters of the larger diameter portion being positioned and adapted jointly to cut pairs of grooves in opposite sides of said logs to form the side corners of a cant being formed by said machine.

18. A machine to produce from round logs a cant of four sides at right angles to each other automatically while making a single pass through said machine and comprising in combination, (a) an elongated base frame having log inlet means at one end and cant discharge means at the other, (b) an upper frame substantially coextensive in length with and parallel to said base frame, (c) means extending between said frames to guide and effect vertical adjustment therebetween, (d) a conveyor mounted upon said base frame to provide a horizontal path of movement through the machine for a log and power means to drive it, (e) means on said conveyor engaging the lower surface of a log for support and guidance thereof along said path of movement, (f) additional guide means on said upper frame engageable with the upper surface of said log to maintain the same in accurate position along said path of movement, (g) said frames each including similar elongated central beams commonly within a vertical plane, (h) transverse end frame members fixed to the ends of said central beams and said aforementioned guide means extending between said frames being on the opposite ends of said end frame members, (i) supplementary frame members spaced along said central beams and extending transversely to opposite sides thereof, and (j) cutting means mounted respectively upon said supplementary frame members of said upper and lower frames in sequence and being positioned for operation respectively upon substantially the upper and lower halves of a log and respectively at opposite sides of a vertical plane intersecting said conveyor and additional guide means, said cutting means being of toothed rotary type and operable upon axes in longitudinally spaced planes transverse to said path of movement of a log through said machine, said axes being at an angle of substantially 45° to said vertical plane and said cutting means being operable at spaced stations along said path of movement to cut portions from said log along the upper and lower portions thereof respectively at opposite sides of said vertical plane to produce four side surfaces on said log at a right angle to each other and respectively at an angle of 45° to said vertical plane, whereby the vertical adjustability of said frames enables the machine to process logs of a substantial range of diameters.

19. The machine according to claim 18 in which said supplementary frame members are rigid plate-like members positioned saddle-like upon and welded to said central beams of said frames, respectively being staggered longitudinally to prevent interference between the cutting members on said upper and lower frames, and said plate-like members also supporting power means for the cutting members supported thereby.

20. The machine according to claim 18 further including adjacent the inlet end thereof chipping cutters respectively supported upon said upper and base frames and shaped to cut pairs of adjacent grooves respectively in the upper and lower surfaces of said logs to form between said grooves elongated ridges comprising corners of a cant and each having surfaces at a right angle to each other, said conveyor having in the upper surface thereof support means grooved in complementary shape to said ridge on the lower surface of said log and said additional guide means on said upper frame having means to engage complementarily the ridge in the upper surface of said log to cooperate with said conveyor in a manner to firmly and accurately support and position a log throughout the movement thereof between said inlet and discharge means of said machine while said cutting means are cutting portions from said log to form a cant of desired transverse dimension.

21. The machine according to claim 20 in which the outermost side surfaces of said pairs of grooves comprise side edges of boards to be removed from a log incident to forming a cant of a size commensurate with the diameter of said log, and said cutting means being of different types operable upon said axes at opposite sides of a vertical plane and respectively comprising pairs of rotary chipping cutter assemblies at right angles in each pair and said pairs being positioned at stations longitudinally staggered along each path inwardly from said inlet end and operable to remove slab portions respectively from the upper and lower portions of said log and at opposite sides of said vertical plane to form flat surfaces parallel to but spaced radially outward from the surfaces of a cant to be produced from said log and comprising the outer surfaces of boards and also cut notches in the opposite sides of said log comprising side corners of said cant being formed, and said cutting means further comprising pairs of rotary saws each at a right angle to each other and said pairs being longitudinally spaced from each other and downstream from said pairs of chipping cutters and said saws being disposed in planes extending at right angles to each other between the corners formed by said chipping cutters for said cant and operable to saw boards from said log and simultaneously to form the outer surfaces of said cant.

22. The machine according to claim 21 in which the saws to remove boards from the lower portions of the logs are positioned immediately downstream from said chipping cutters to permit the lower boards which are sawed from the log to fall by gravity from the path of movement of said logs, and said machine further being provided with receiving and support means downstream from the saws operating upon the upper portion of the log and in line with the boards sawed thereby and operable to slidably support said boards separately from said cant as it is discharged from the machine in a manner to prevent interference between said cant and boards.

23. The machine according to claim 18 in which said means extending between said frames to guide and effect vertical adjustment therebetween comprise vertical posts fixed to the outer ends of the transverse end frame members of the base frame, means on the end of the end frame members of said upper frame slidably engaging certain sides of said posts to prevent relative lateral or longitudinal movement between said frames, and means to effect said vertical adjustment between said frames comprising vertical screw jacks positioned at longitudinally spaced locations along the sides of said frames and rotatably engaging stationary internally threaded members in one of said frames, means in the other frame operable to rotate said jacks simultaneously uniformly to insure parallelism between said frames in all adjusted positions between the same.

24. The machine according to claim 23 in which said screw jacks are rotatably supported vertically by said base frame adjacent the outer ends of the end frame members thereof and said stationary internally threaded members engaged thereby are supported by said end frame members of said upper frame adjacent the outer ends thereof, and power means to simultaneously rotate said screw jacks supported by said upper frame.

25. A method of converting a log automatically to a cant and limited number of boards comprising the successive steps of:

(a) feeding a log along a predetermined straight path while preventing rotation of the log, (b) forming pairs of adjacent V-shaped grooves respectively in the top and bottom portions of said log as fed along said path to provide guide means along said log in the form of opposite top and bottom corners of the cant to be formed by said method, (c) removing the normal slab areas from opposite sides of the upper portions of said log at a right angle to each other to form the outer surfaces of two upper boards of which the upper edges are formed by said pairs of grooves in the top portion of said log and simultaneously forming single grooves at opposite sides of said log to define the lower edges of said upper boards and portions of opposite side corners of said cant, (d) removing the normal slab areas from the opposite sides of the lower portions of said log at a right angle to each other to form the outer surfaces of two lower boards and also simultaneously form single grooves at the opposite sides of said log adjacent said aforementioned single grooves in the sides of said log to complete the formation of opposite side corners of said cant and the upper side edges of a pair of lower boards, (e) sawing lower boards from said log to form the two lower sides of said cant, and (f) sawing upper boards from said log to form the two upper sides of said cant to form four boards and a cant having four sides at right angles to each other.

* * * * *